US008287198B2

(12) United States Patent
Yamagata

(10) Patent No.: US 8,287,198 B2
(45) **Date of Patent: *Oct. 16, 2012**

(54) PRINTER

(75) Inventor: Yasuhiro Yamagata, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/879,279

(22) Filed: Sep. 10, 2010

(65) Prior Publication Data

US 2010/0329769 A1 Dec. 30, 2010

Related U.S. Application Data

(63) Continuation of application No. 11/646,038, filed on Dec. 27, 2006.

(30) Foreign Application Priority Data

Dec. 27, 2005 (JP) ..... 2005-374481
Dec. 27, 2005 (JP) ..... 2005-374482

(51) Int. Cl.
*B41J 29/00* (2006.01)

(52) U.S. Cl. ..... 400/664; 400/693

(58) Field of Classification Search ..... 400/644, 400/693

See application file for complete search history.

(56) References Cited

U.S. PATENT DOCUMENTS

| | | | | |
|---|---|---|---|---|
| 4,027,590 | A * | 6/1977 | Seidl et al. | 101/288 |
| 5,613,788 | A | 3/1997 | Dobring | |
| 5,865,084 | A * | 2/1999 | Robertson et al. | 83/649 |
| 5,884,861 | A * | 3/1999 | Hosomi et al. | 242/563 |
| 6,022,158 | A | 2/2000 | Nakayama et al. | |
| 6,474,883 | B1 | 11/2002 | Kawakami et al. | |
| 6,491,459 | B2 | 12/2002 | Hosomi | |
| 6,494,631 | B1 * | 12/2002 | Mastinick | 400/208 |
| 6,502,784 | B1 * | 1/2003 | Sato | 242/563 |
| 6,789,969 | B2 | 9/2004 | Hirabayashi et al. | |
| 6,916,052 | B2 | 7/2005 | Yamada et al. | |
| 7,273,325 | B2 * | 9/2007 | Watanabe et al. | 400/621 |
| 7,404,683 | B2 * | 7/2008 | Mochizuki et al. | 400/613.1 |
| 7,547,153 | B2 * | 6/2009 | Yoshioka | 400/621 |
| 7,553,098 | B2 * | 6/2009 | Maekawa et al. | 400/613 |
| 2005/0286954 | A1 | 12/2005 | Suzuki et al. | |

FOREIGN PATENT DOCUMENTS

| | | |
|---|---|---|
| JP | 11-129590 | 5/1999 |
| JP | 11-245476 | 9/1999 |
| JP | 2000-225751 | 8/2000 |

(Continued)

*Primary Examiner* — Anthony Nguyen

(57) ABSTRACT

A roll paper printer having a cover movable between an open and closed position with the printer having hooks on locking levers disposed to the cover to hold the cover in the locked position upon engaging pins located on the printer body side and having an opening lever to unlock the cover. The printer also includes a paper cutter device having a stationary knife which is attached to the cover and contact plate parts which extend from the stationary knife for contacting the front panel part on the printer body and having extension springs disposed in tension for pulling the stationary knife towards the back of the printer such that upon closing the cover the contact plate parts push the cover to the front of the printer. This causes the hooks of the locking levers to press from the back against the engagement pins to eliminate any play in the cover when in cover is in the locked position and to assist in opening the cover when the cover opening lever is operated.

8 Claims, 6 Drawing Sheets

FOREIGN PATENT DOCUMENTS

| | | |
|---|---|---|
| JP | 3076979 | 2/2001 |
| JP | 2001-071606 | 3/2001 |
| JP | 2001-158141 | 6/2001 |
| JP | 2001-253143 | 9/2001 |
| JP | 2002-308482 | 10/2002 |
| JP | 2004-009623 | 1/2004 |
| JP | 2004-058275 | 2/2004 |
| JP | 2004-268207 | 9/2004 |
| JP | 2005-096290 | 4/2005 |
| JP | 2005-133755 | 5/2005 |
| JP | 2006-007467 | 1/2006 |
| JP | 2006-008353 | 1/2006 |

* cited by examiner

PRINTER

RELATED APPLICATIONS

This application is a continuation of, and claims priority under 35 U.S.C. §120 on, U.S. patent application Ser. No. 11/646,038, filed Dec. 27, 2006. The content of this related application is incorporated by reference herein in its entirety. Japanese patent application nos. 2005-374481 and 2005-374482 are also incorporated by reference herein in their entirety.

BACKGROUND

1. Field of Invention

The present invention relates to a printer having a mechanism for locking a cover in a closed position and for releasing the mechanism so that when the cover is closed it is held tightly without permitting play in the closed position while also improving operability when releasing the lock and opening the cover.

2. Description of Related Art

In order to enable easily loading and replacing the roll paper in roll paper printers such as used for printing sales receipts, some roll paper printers have a mechanism that opens the paper transportation path from the roll paper compartment to the paper exit when the cover to the roll paper compartment is opened. This type of roll paper printer may have a platen member that opposes the print head, an opposing pressure roller that presses the paper to the paper feed roller, and a stationary knife of a scissor type paper cutter device which includes a stationary knife and a movable knife. The platen member, pressure roller, and stationary knife are disposed to the cover. When the cover opens the platen member, pressure roller, and stationary knife move away from the corresponding opposing members, i.e., the print head, paper feed roller, and movable knife, which causes the paper transportation path to open. As a result, opening the cover, loading the roll paper into the roll paper compartment, pulling the leading end of the roll paper out from the roll paper compartment, and closing the cover results in the paper being automatically threaded through the paper transportation path as is taught in JP-A-2002-308482.

JP-A-2001-158141 teaches a lock mechanism for locking the cover in the closed position using an engagement pin disposed to the printer body and a locking lever having a hook formed on the distal end disposed to the cover for engaging the engagement pin.

The locking lever is urged to the locking side by the force of a spring. When the cover closes, the distal end of the locking lever meets the engagement pin and the engagement pin pushes the locking lever up (or down) as the cover continues to close so that the hook rides over the engagement pin. When the hook rides over the engagement pin the force of the spring moves the hook from the front in the closing direction of the cover (from the back side of the engagement pin) to the locking position where the hook engages the engagement pin, thereby locking the cover closed.

If the hook of the locking lever cannot ride over the engagement pin on the printer body side, this lock mechanism cannot reach the locked position. Extra space is therefore provided behind the engagement pin so that the cover can be pushed beyond the closed position and the hook part of the locking lever can reliably engage the engagement pin.

Because the cover can be pushed beyond the closed position, the cover can move slightly in the opening/closing direction when locked by the lock mechanism. As a result, in some situations, the cover cannot be positioned without having play in the closed position. If the closed position of the cover shifts, the paper pressure roller mounted to the cover may not be able to apply appropriate pressure to the paper feed roller on the printer body side. If the contact position of the rollers shifts, the nipping position of the paper conveyed between the rollers shifts and the paper nipping force of the rollers changes. This causes the paper feed pitch to vary and lowers paper feed precision.

Furthermore, to open the cover a cover opening lever must be operated to move the locking lever in resistance to the force of the spring to the release position, and the cover must be moved in the opening direction while holding the cover opening lever in the lock-release position. More specifically, the cover must be moved in the opening direction to a position where the locking lever will not re-engage the engagement pin when the cover opening lever is released.

Simply operating the cover opening lever thus leaves the locking lever positioned to engage the engagement pin, and if the cover opening lever is released immediately the spring causes the locking lever to return to the locked position engaging the engagement pin and the cover cannot be opened.

The printer of this invention enables the cover to lock in the closed position without play and to reliably open the cover by operating the cover opening lever only once.

SUMMARY OF INVENTION

A printer according to a first aspect of the invention has a body; a cover movably attached to the body for movement into an open or closed position; a lock mechanism for locking the cover in the closed position or for unlocking the cover; and a positioning and urging mechanism for directing the cover to move in an opening/closing direction relative to the open or closed position of the cover so as to minimize play when the cover is locked in the closed position. The lock mechanism has a body-side engaging unit disposed to the printer body, a cover-side engaging unit disposed to the cover, and a lever for moving the cover-side engaging unit for disengaging the cover-side engaging unit from the body-side engaging unit. The positioning and urging mechanism has a cover-side contact part disposed to the cover in an arrangement relative to the printer body such that when the cover is in the closed position the cover-side contact part is pressed into the body to cause the cover to move into the open position in response to the unlocking of the cover by the control lever; and an urging member connected between the cover-side contact part and the cover for urging the cover-side contact part toward the cover closing direction.

According to embodiments of the invention, when the cover closes the cover-side contact part contacts the printer body-side contact part and is pushed in the cover opening direction. Substantially at the same time the cover-side engaging unit of the lock mechanism rides over and engages the body-side engaging unit, and the cover is locked closed. The contact part of the cover is pushed away from the printer body in the cover opening direction and this pressure acts on the cover. Force pushing the cover in the opening direction is thus applied from the printer body to the cover when the cover is locked in the closed position. The cover-side engaging unit is thus reliably pressed against the body-side engaging unit from the front in the cover closing direction, and the cover is locked without play in the closed position. When the lock release lever is operated to release the cover lock, the force applied from the printer body to the cover compels the cover in the opening direction. Because the cover is unlocked and compelled automatically in the opening direction by simply operating the lock release lever once, the operation required to open the cover is extremely simple.

In a roll paper printer, for example, a paper cutter device is typically disposed near the paper exit. In such a printer the stationary knife is attached to the cover and the movable knife is disposed to the printer body, the stationary knife is used as the cover-side contact part and the urging member can be a spring member disposed in tension between the stationary knife and a position offset in the cover closing direction from the stationary knife on the cover. A separate member is therefore not needed to function as the cover-side contact part, and the cover-side contact part can be easily disposed.

When the invention is applied to a roll paper printer, the cover can be used as a cover for opening and closing an opening for loading and unloading roll paper in the roll paper compartment. To simplify the task of loading roll paper, a body-side roller for conveying the paper is disposed to the printer body and a cover-side roller contacting the body-side roller is disposed to the cover; and when the cover opens, a paper transportation path for conveying paper from the roll paper compartment between the body-side roller and cover-side roller and between the stationary knife and movable knife of the paper cutter device is opened.

A positioning and urging mechanism in this roll paper printer constantly pushes the locked cover in the cover opening direction. The cover can therefore be locked without play in the closed position, and the cover-side roller can be set with good precision in contact with the body-side roller. Problems resulting from a drop in paper transportation precision due to deviation in where the rollers contact can therefore be reliably prevented.

A printer according to another aspect of the invention has a housing for storing continuous paper; a moveable cover for opening and closing an opening in the housing; a housing-side engaging unit disposed to the housing; a locking lever that is pivotably disposed to the cover for engaging and disengaging the housing-side engaging unit, wherein the pivot of the lever, the housing-side engaging unit, and the engaging part of the lever are positioned in this order when the cover is closed; a cutting mechanism having a movable knife disposed on the housing side and a stationary knife disposed on the cover side for cutting the paper when the cover is closed; a contact part disposed to the stationary knife for contacting the housing side when the cover is closed; and an urging member connected between the stationary knife and the cover for urging the stationary knife in the closing direction of the cover. When the cover is closed the contact part of the stationary knife touches the housing side and the cover is urged by the urging member in the cover opening direction.

A printer according to another aspect of the invention has a housing for storing continuous paper; a cover pivotally disposed to the housing such that the cover can be moved in cover closing direction to a closed position or in a cover opening direction to an open position; a lock mechanism having a first engaging unit disposed to the housing and a second engaging unit disposed to the cover for locking the cover when in the closed position; a release member for moving the second engaging unit to release the engagement of the first and second engaging units; and a cutting mechanism having a movable knife disposed on the housing side, a stationary knife disposed on the cover side, and an urging member for urging the stationary knife in the cover closing direction. When the cover is in the closed position, the stationary knife contacts the housing and is positioned to the movable knife by being urged by the urging member to the housing side. The stationary knife contacts the housing and is positioned to the movable knife by being urged by the urging member to the housing side when the cover is in the closed position. A contact part disposed to the stationary knife contacts the housing side when the cover is closed. The urging member is connected between the stationary knife and the cover for urging the stationary knife in the closing direction of the cover such that when the cover is in the closed position the cover is pressed in the cover opening direction which causes the cover to move forward in the cover opening direction when unlocking the locking mechanism and releasing the engagement of the first and second engaging unit.

Accordingly, in embodiments, resistance to the urging force of the urging member acts on the stationary knife when the cover is in the closed position, and the cover is pressed in the cover opening direction and the second engaging unit is pressed to the first engaging unit by said resistance, and when engagement of the first and second engaging units is released by the release member when the cover is in the closed position the cover is pushed by said resistance in the cover opening direction.

Other objects and attainments together with a fuller understanding of the invention will become apparent and appreciated by referring to the following description and claims taken in conjunction with the accompanying drawings.

DESCRIPTION OF THE PREFERRED EMBODIMENTS

A preferred embodiment of a printer according to the present invention is described below with reference to the accompanying figures.

General Configuration

Figure 1:
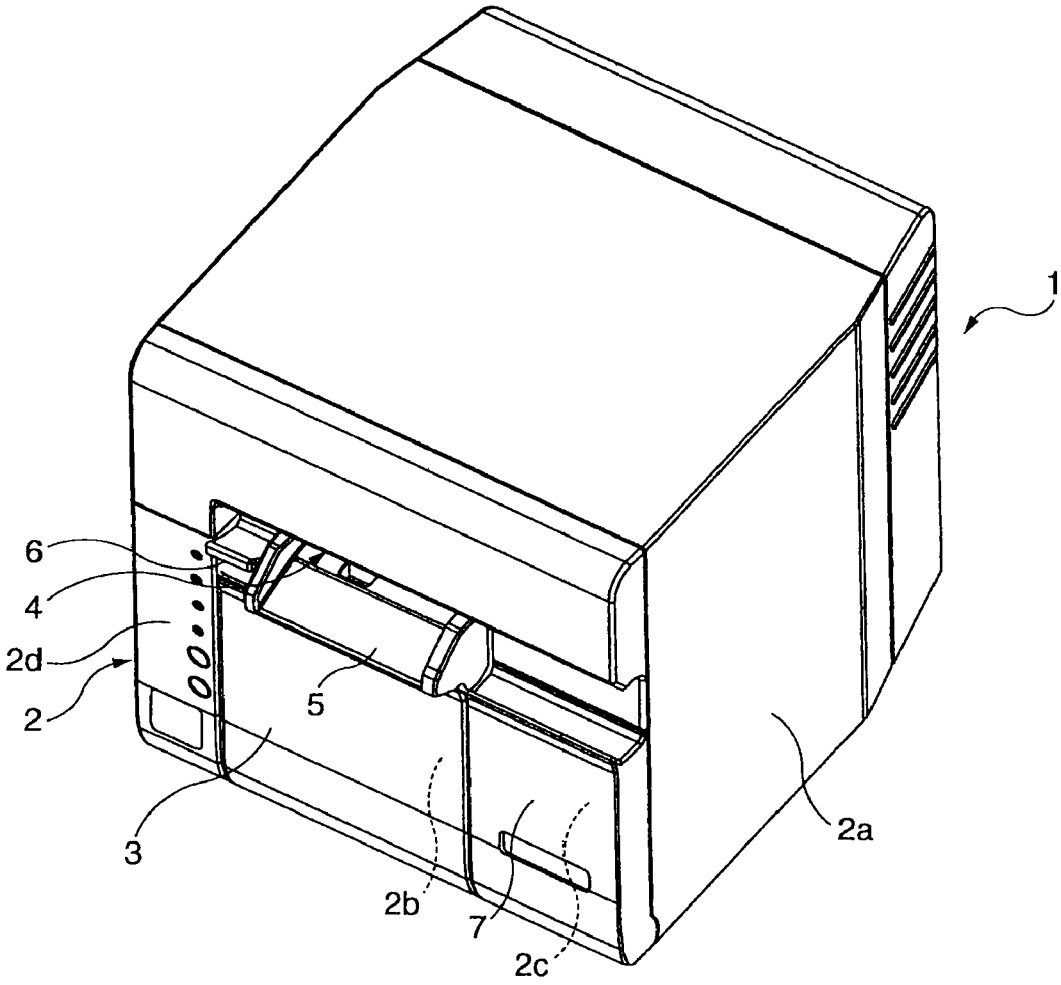
FIG. 1 is an external oblique view of a roll paper printer according to a preferred embodiment of the invention.
Figure 2:
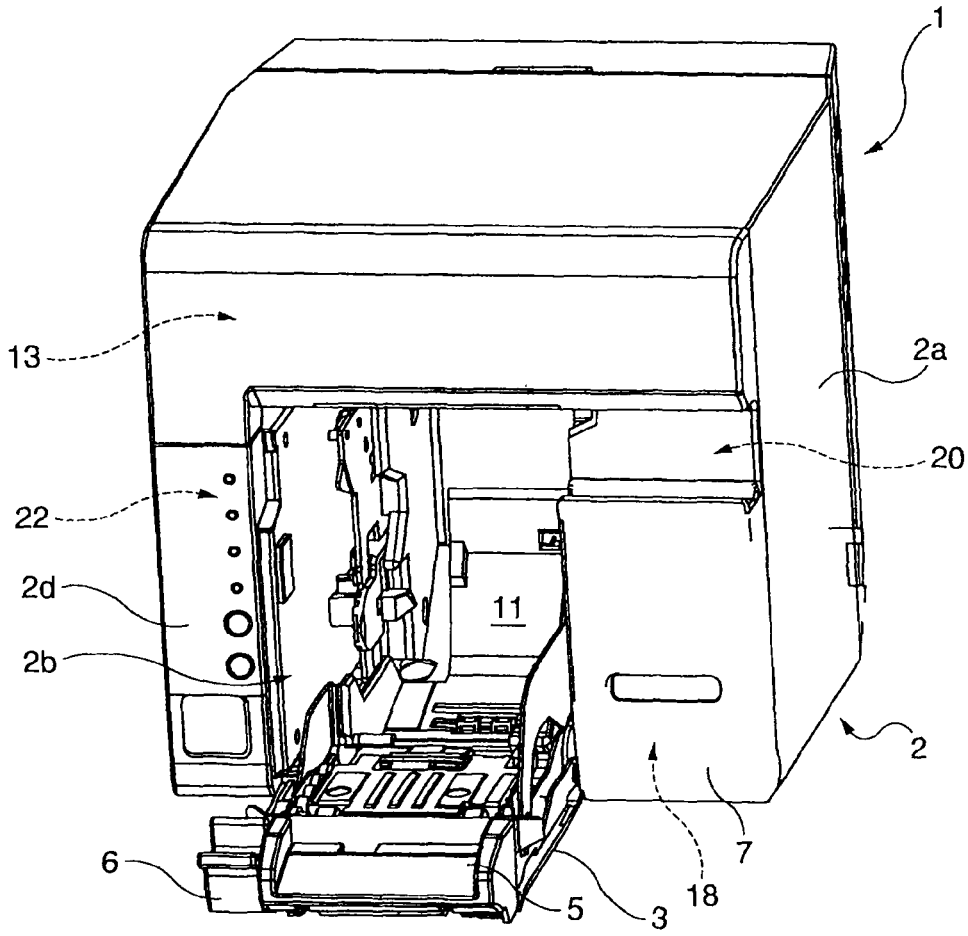
FIG. 2 is an external oblique view of the roll paper printer with the cover open.

FIG. 1 shows the appearance of an inkjet roll paper printer according to the present invention, and FIG. 2 shows the printer with the paper compartment cover fully open. The roll paper printer 1 has a body 2 with a basically rectangular box-like shape, and a cover 3 attached to the front of the body 2.

A paper exit 4 of a specific width is formed at the front of the outside case 2*a* of the body 2. An exit guide 5 protrudes to the front below the paper exit 4, and a cover opening lever 6 (lock release lever, release member) is located beside the exit guide 5. A square opening 2*b* for loading and removing roll paper is formed below the exit guide 5 and cover opening lever 6 of the outside case 2*a*, and the cover 3 closes this opening 2*b*.

Operating the cover opening lever 6 releases the cover lock and pushes the cover 3 in the opening direction. Pulling forward on the exit guide 5 then causes the cover 3 to pivot and swing forward from the bottom end part of the cover 3 to a substantially horizontal position as shown in FIG. 2. Opening the cover 3 also opens the roll paper compartment 11 rendered inside the printer so that roll paper can be loaded and replaced from the front of the printer.

Another opening 2*c* is also formed on the right beside the cover 3, and a cover 7 that pivots at the bottom to open and close is attached at this opening 2*c*. Opening this cover 7 opens the ink cartridge compartment 18 (ink supply unit) so that ink cartridges can be replaced.

An operating panel 2*d* having a number of LEOs used as state indicators as well as a paper feed button, for example, is disposed on the left beside the cover 3.

Figure 3:
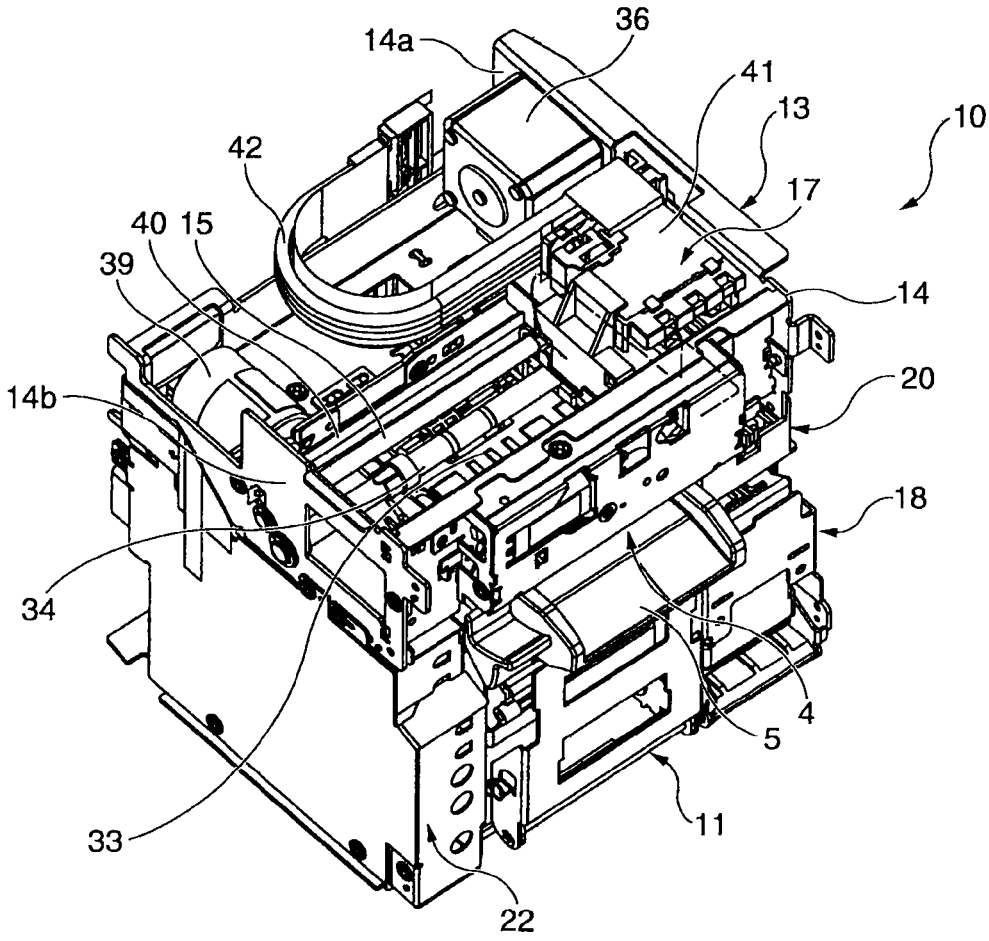
FIG. 3 is an oblique view of the print mechanism unit in the roll paper printer.
Figure 4:
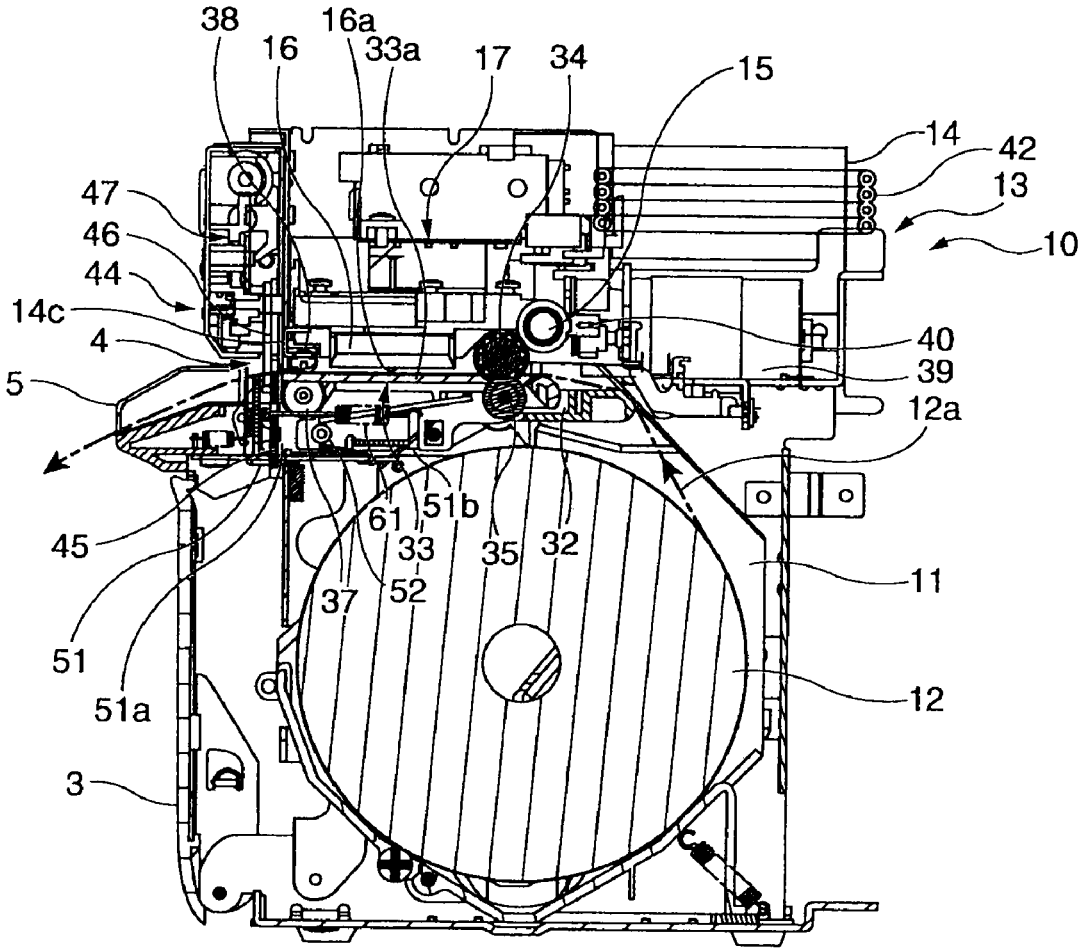
FIG. 4 is a schematic side section view of the print mechanism unit.

FIG. 3 is an oblique view of the printer mechanism unit 10 inside the outside case 2*a* of the roll paper printer 1. FIG. 4 is a schematic vertical side view of the printer mechanism unit 10 shown in section.

The printer mechanism unit 10 has a roll paper compartment 11 substantially in the widthwise center of the printer mechanism unit 10. The roll paper 12 is placed sideways to the printer inside the roll paper compartment 11 so that the roll paper 12 rolls as paper is pulled off. A head unit 13 is disposed horizontally above the roll paper compartment 11.

The head unit 13 has a head unit frame 14. A carriage guide shaft 15 passes horizontally between the right and left side panels 14*a* and 14*b* of the head unit frame 14. A carriage 17 carrying an inkjet head 16 facing down can move bidirectionally along the carriage guide shaft 15.

As shown in FIG. 3, the ink cartridge compartment 18 and head maintenance unit 20 are disposed below the head unit 13 on the right side of the roll paper compartment 11. Ink cartridges not shown can be loaded into the ink cartridge compartment 18 below the head maintenance unit 20. Similarly to a head maintenance unit as known from the literature, a wiper for wiping the nozzle face 16*a* of the inkjet head 16 and a recovery unit for recovering waste ink discharged or purged from the nozzles of the nozzle face 16*a* are disposed in the head maintenance unit 20 above the ink cartridge compartment 18. A circuit board housing 22 containing the control circuit board is located below the head unit 13 on the left side of the roll paper compartment 11.

As shown in FIG. 4, a paper guide 32 is disposed horizontally widthwise to the printer at a position behind and between the roll paper compartment 11 and head unit 13 inside the printer mechanism unit 10. A platen guide 33 is disposed horizontally in the front to back direction of the printer in front of and above the paper guide 32. The inkjet head 16 carried on the carriage 17 is directly above the platen guide 33. The nozzle face 16*a* of the inkjet head 16 is opposite the top surface 33*a* of the platen guide 33 with a constant gap therebetween, and the printing position is determined by this top surface 33*a*.

A first paper feed roller 34 is disposed horizontally widthwise to the printer between the platen guide 33 and paper guide 32. A first paper pressure roller 35 of a specific width is pressed from below with a predetermined force against the first paper feed roller 34. The first paper feed roller 34 is driven by a paper feed motor 36 disposed to the head unit 13 by means of an intervening belt and pulley power transfer mechanism 36*a* (see FIG. 5). A second paper feed roller 37 is disposed to a position at the front edge side of the platen guide 33. A second paper pressure roller 38 is pressed from above against the second paper feed roller 37 with a predetermined force.

The carriage 17 is moved bidirectionally along the printer width (the printing width direction) by a carriage transportation mechanism including a carriage motor 39 and timing belt 40 (see FIG. 3). As the carriage 17 travels back and forth, the inkjet head 16 mounted on the carriage 17 is driven to print on the surface of the printing paper 12*a* delivered from the roll paper 12 passed the printing position.

An ink damper 41 is mounted on the carriage 17, and a flexible ink tube 42 is connected to the ink damper 41. Colored ink is supplied from the ink cartridges in the ink cartridge compartment 18 through the ink tube 42 to the inkjet head 16 enabling full color printing by the inkjet head 16.

A scissor-type paper cutter device 44 is located near the paper exit 4 on the upstream side. The stationary knife 45 of the paper cutter device 44 is disposed vertically with the cutting edge up, and the movable knife 46 is disposed vertically with the cutting edge down. The movable knife 46 pivots at one end thereof widthwise to the printer and is driven bidirectionally up and down by a movable knife drive mechanism 47. As the movable knife 46 rotates downward the point of contact with the stationary knife 45 moves across the width of the printer and thus cuts across the width of the printing paper 12*a* located between the knives.

The platen guide 33, paper guide 32, first paper pressure roller 35, second paper feed roller 37, and stationary knife 45 are disposed to the cover frame 51 of the cover 3. The cover opening lever 6 and exit guide 5 are attached to the front portion of the cover frame 51. Opening the cover 3 both opens the opening 2*b* for loading and removing roll paper to the roll paper compartment 11 and opens the paper transportation path from the roll paper compartment 11 to the paper exit 4. As a result, when roll paper 12 is then placed in the roll paper compartment 11, a printing paper 12*a* leader of a certain length is pulled off the roll paper 12 and the cover 3 is then closed, the printing paper 12*a* pulled from the roll paper 12 in the roll paper compartment 11 is guided by the paper guide 32 and is automatically threaded through the paper transportation path passing from between the first paper feed roller 34 and first paper pressure roller 35 over the top surface 33*a* of the platen guide 33 (the printing position), between the second paper feed roller 37 and second paper pressure roller 38, and to the outside from the paper exit 4.

Transportation of the printing paper 12*a* begins when the first paper feed roller 34 and second paper feed roller 37 then begin to turn. The inkjet head 16 is driven synchronized to printing paper 12*a* movement to print on the surface of the printing paper 12*a* as the paper passes the printing position. After printing ends conveying the printing paper 12*a* stops with the printed portion discharged from the paper exit 4, the paper cutter device 44 then cuts the printing paper 12*a*, and the printed portion severed from the roll can be issued as a sales receipt, for example.

Cover Lock Mechanism And Positioning And Urging Mechanism

The lock mechanism for locking the cover 3 in the closed position, and the positioning and urging mechanism for positioning the cover 3 in the closed position and urging the cover 3 in the opening direction when the cover 3 lock is released, are described next with reference to FIG. 4 to FIG. 6.

Figure 5:
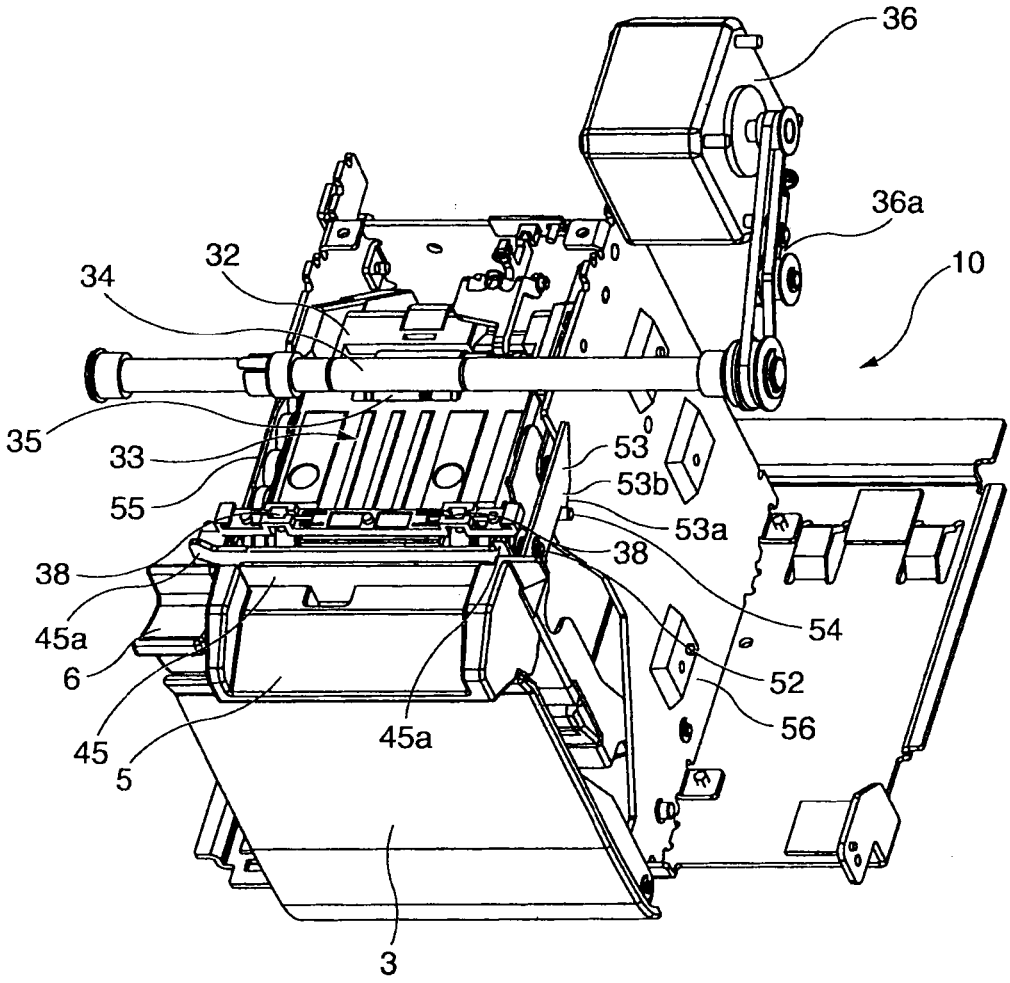
FIG. 5 is an oblique view shows the print mechanism unit with some portions removed for clarity.

FIG. 5 is an oblique view of the printer mechanism unit 10 with the head unit 13 other than the paper feed motor 36 and power transfer portion thereof, the ink cartridge compartment 18, the head maintenance unit 20, and the circuit board housing 22 removed. FIG. 6 describes the main parts of the lock mechanism and the positioning and urging mechanism.

The lock mechanism for securing the cover 3 in the closed position includes a support shaft 52 disposed at the front portion of the cover frame 51 to rotate freely in the opening and closing direction of the cover 3, a pair of left and right locking levers 53 (cover-side engaging unit) fixed at opposite ends of the support shaft 52, and a pair of left and right engagement pins 54 (body-side engaging unit, frame-side engaging unit) disposed to the body 2. Note that these parts on only one side of the printer are shown in the figure.

The cover opening lever 6 is fixed on the end of the support shaft 52 so that pressing on the cover opening lever 6 causes the support shaft 52 to rotate and the distal end portion (the end towards the back of the printer) of the locking levers 53 fixed on both ends of the support shaft 52 to rotate up. The locking levers 53 are constantly urged in the locking direction (downward in this arrangement) by a torsion spring.

The locking levers 53 are vertical plates of a substantially constant width protruding from both ends of the support shaft 52 toward the back of the printer, and the bottom edge of the distal end part of each lever slopes from the back to the front of the printer, rendering incline 53*a*. A hook 53*b* that can engage the engagement pin 54 from the back side of the printer (the front in the direction in which the cover closes) is formed at the bottom end of the incline 53*a*: More specifically, an engaging surface 53*c* curves upward continuously from the bottom end of the incline 53*a*, and a bottom edge 53*d* curves continuously from the top end of this engaging surface 53*c* toward the front of the printer.

The left and right engagement pins 54 on the body 2 side are studs that protrude to the outside widthwise to the printer almost perpendicularly to the outside surfaces of the side panel portions 55 and 56 on opposite sides of the roll paper compartment 11. When the cover 3 closes the incline 53*a* of the locking lever 53 contacts the engagement pin 54. As the cover 3 continues to close the locking levers 53 are pushed up, the hooks 53*b* ride over the engagement pins 54, and the hooks 53*b* drop into the locked position engaging the engagement pins 54 from the back side of the printer.

When the cover opening lever 6 is then depressed when in this locked position, the distal ends of the left and right locking levers 53 pivot up, the hooks 53*b* rise and disengage the engagement pins 54, and the cover is thus unlocked.

So that the locking levers 53 can reliably lock onto the engagement pins 54, the cover 3 can be pushed a slight extra distance towards the back side of the printer from this closed position. As a result, the cover 3 can move slightly in the front to back direction of the printer when in this locked position. To prevent such movement, this embodiment of the invention has a positioning mechanism (positioning and urging mechanism) for positioning the cover 3 in the Closed position.

The positioning and urging mechanism according to this embodiment of the invention includes the stationary knife 45 disposed to the cover 3 and two coil extension springs 61 (urging members) that pull the stationary knife 45 toward the back of the printer (in the closing direction). The stationary knife 45 is disposed so that it can be moved slightly by means of the front end part 51*a* of the cover frame 51 in the front to back direction of the printer (the cover opening and closing direction). The extension springs 61 are disposed with one end attached to the left and right ends of the stationary knife 45 and the other end attached to spring catches 51 *b* disposed to the cover frame 51 at a position towards the back of the printer from the stationary knife 45. These extension springs 61 constantly urge the stationary knife 45 towards the back of the printer (in the cover closing direction).

A pair of left and right contact plate parts 45*a* (cover-side contact units) are formed projecting up at the left and right ends of the stationary knife 45. These contact plate parts 45*a* can contact front parts 14*d* (body-side contact units) rendered at the bottom edge parts of both ends of the front panel part 14*c* of the head unit frame 14 of the head unit 13. This embodiment of the invention is configured so that the contact plate parts 45*a* contact the front panel part 14*c* just before the hooks 53*b* of the locking levers 53 of the lock mechanism engage the engagement pins 54 when the cover 3 is closed. The stationary knife 45 is thus positioned to the movable knife 46 with the contact plate parts 45*a* touching the front panel part 14*c* and the contact plate parts 45*a* pressed against the front panel part 14*c* by the extension springs 61.

The operation of the lock mechanism and positioning and urging mechanism thus arranged is described next.

Figure 6:
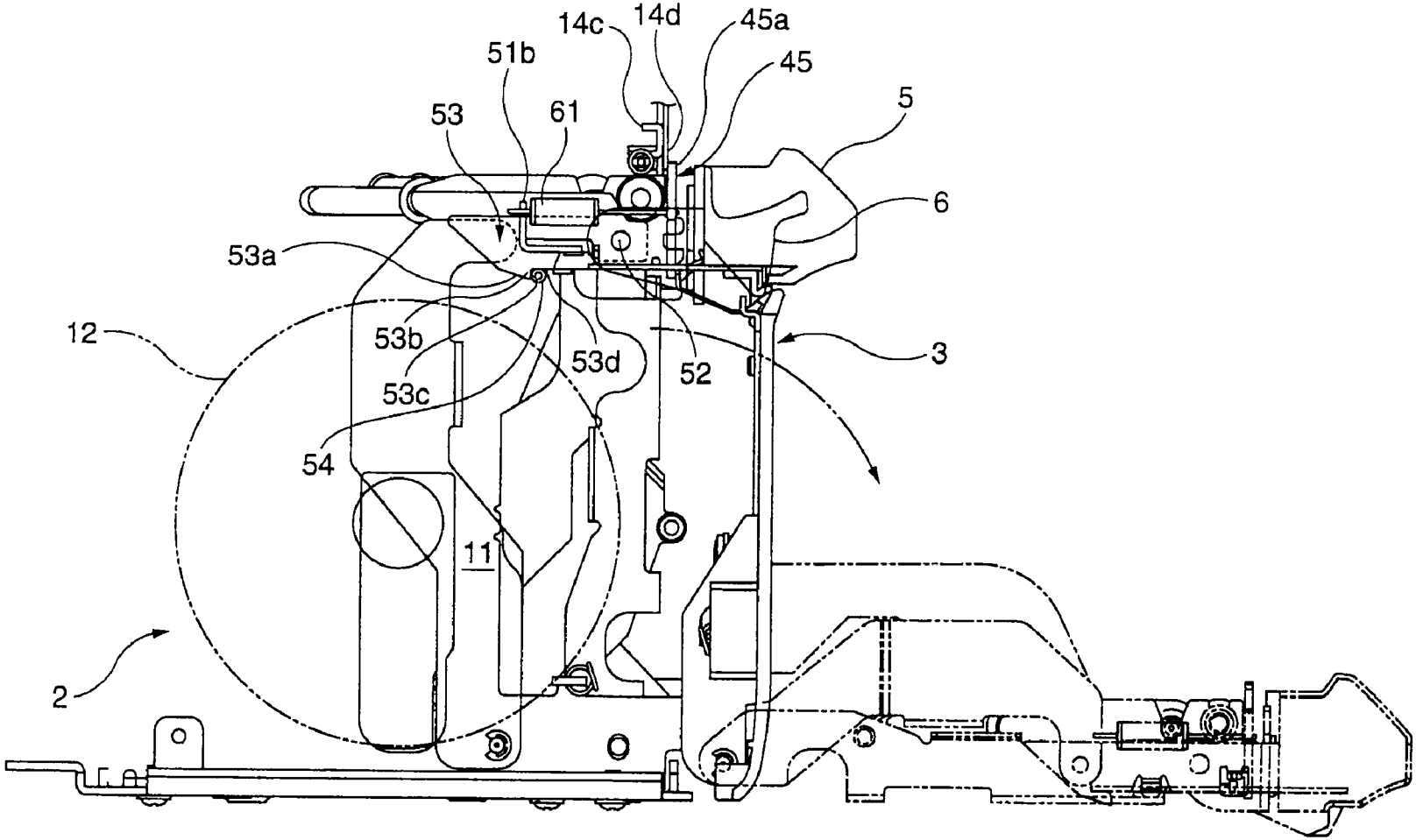
FIG. 6 describes the cover lock mechanism and positioning and urging mechanism.

As shown in FIG. 6, when the cover 3 is closed the left and right contact plate parts 45*a* of the stationary knife 45 contact the left and right front parts 14*d* of the front panel part 14*c* on the body 2 side just before the hooks 53*b* of the left and right locking levers 53 of the lock mechanism engage the left and right engagement pins 54 on the printer body 2 side. As the cover 3 is pressed further in the closing direction so that the lock mechanism locks, the stationary knife 45 is pressed with a specific amount of force to the front from the body side.

The stationary knife 45 is connected (supported) on the cover frame 51 of the cover 3 through an intervening pair of left and right extension springs 61. As a result, the pressure on the stationary knife 45 from the body 2 side pushes the cover 3 toward the front of the printer, and the engaging surface 53*c* of the hook 53*b* of the left and right locking levers 53 of the lock mechanism is pressed from the back side of the printer against the corresponding left and right engagement pin 54. More specifically, the cover 3 is locked with no play in the closed position.

When the cover 3 is in the closed position, the first paper pressure roller 35 and second paper feed roller 37 disposed to the cover 3 are reliably positioned in contact with the first paper feed roller 34 and second paper pressure roller 38 disposed on the body 2 side. The nipping force of the rollers can therefore be held constant, and problems such as a drop in print quality resulting from inconsistent nipping force resulting in a variable paper feed pitch due to deviation in the roller contact position can be prevented.

Operation when the cover 3 that is locked in the closed position is opened is described next.

When the cover opening lever 6 is depressed, the left and right locking levers 53 of the lock mechanism pivot, the hooks 53*b* on the ends of the levers move up and disengage the left and right engagement pins 54 on the body 2 side, and the lock is released.

As described above, the urging mechanism (positioning and urging mechanism) works from the body side to apply a predetermined force on the cover 3 in the opening direction. When the lock is disengaged, the pressure of this force causes the cover 3 to automatically pop forward (in the opening direction). This causes the hooks 53*b* of the locking levers 53 of the lock mechanism to move to a position to the front of the printer from the engagement pins 54 so that even if the cover opening lever 6 is released the cover 3 will not be locked again.

Once the cover 3 is thus pushed forward, the weight of the cover causes the cover 3 to pivot on its bottom end and open automatically to the full open position. To control the speed with which the cover 3 opens a coil spring that urges the cover 3 with a predetermined force in the closing direction can be connected between the cover 3 and body 2. Alternatively, a torsion spring could be disposed to the support shaft on which the cover 3 pivots.

The simple operation of depressing the cover opening lever 6 once thus unlocks the cover 3 and automatically pushes the cover 3 in the opening direction. The operation of opening the cover 3 is thus improved.

Variations of the Preferred Embodiment

The invention is described above using a roll paper printer by way of example, but the invention can also be applied to covers on printers other than roll paper printers.

Furthermore, while an inkjet type roll paper printer is described above, the invention can also be applied to printers using a non-inkjet type print head such as thermal or impact types.

Yet further, the same mechanism is used for the positioning mechanism for positioning the cover in the closed position and the urging mechanism for pushing the cover in the opening direction, but different mechanisms could be used.

Yet further, the stationary knife of the paper cutter mechanism is used in the cover positioning mechanism, but a location or part on the cover other than the stationary knife could be used.

Yet further, the stationary knife of the paper cutter mechanism is used in the urging mechanism for automatically pushing the cover in the opening direction, but a different part could be affixed to the cover to function as the cover-side contact unit.

In addition, the locking levers are disposed to the cover in the lock mechanism described above, but the locking levers could be disposed to the body and the engagement pins to the cover. The shape and construction of the body-side engagement parts and cover-side engagement parts can also be varied in many ways.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A printer comprising:

a body;

a cover movably attached to the body of the printer for movement into an open or closed position;

a lock mechanism for locking the cover in the closed position or for unlocking the cover; and a positioning and urging mechanism for directing the cover to move in an opening/closing direction relative to the open or closed position of the cover so as to reduce play when the cover is locked in the closed position;

wherein the lock mechanism comprises:

a body-side engaging unit disposed to the body of the printer, a cover-side engaging unit disposed to the cover, and a lever for moving the cover-side engaging unit for disengaging the cover-side engaging unit from the body-side engaging unit; and wherein the positioning and urging mechanism comprises:

a cover-side contact part disposed to the cover in an arrangement relative to the body of the printer such that when the cover is in the closed position the cover-side contact part is pressed into the body of the printer; and an urging member connected between the cover-side contact part and the cover for urging the cover-side contact part toward the cover closing direction.

2. The printer of claim 1, further comprising:

a paper cutter device including a stationary knife disposed to the cover and a movable knife disposed to the printer body;

wherein the cover-side contact part is disposed to the stationary knife; and wherein the urging member is a spring member disposed in tension between the stationary knife and a position offset in the cover closing direction from the stationary knife on the cover.

3. The printer of claim 2, further comprising:

a roll paper compartment inside the printer body;

wherein the cover in the closed position covers the roll paper compartment and in the open position opens the roll paper compartment for loading and unloading roll paper; and a body-side roller disposed to the printer body for conveying paper from the roll paper compartment, and a cover-side roller disposed to the cover, such that when the cover opens, a paper transportation path is formed for conveying paper from the roll paper compartment between the body-side roller and cover-side roller and between the stationary knife and movable knife of the paper cutter device.

4. A printer comprising:

a housing for storing continuous paper;

a movable cover for opening and closing an opening in the housing;

a housing-side engaging unit disposed to the housing;

a locking lever that is pivotably disposed to the cover for engaging and disengaging the housing-side engaging unit, wherein the pivot of the lever, the housing-side engaging unit, and the engaging part of the lever are positioned in this order when the cover is closed;

a cutting mechanism including a movable knife disposed on the housing side and a stationary knife disposed on the cover side for cutting the continuous paper when the cover is closed;

a contact part disposed to the stationary knife for contacting the housing side when the cover is closed; and an urging member connected and positioned for urging the stationary knife in the closing direction of the cover;

wherein when the cover is closed the contact part of the stationary knife touches the housing side and the cover is urged by the urging member in the cover opening direction.

5. The printer of claim 4, further comprising:

a transportation mechanism including a housing-side roller disposed to the housing and a cover-side roller disposed to the cover for engaging and conveying the continuous paper when the cover is in the closed position.

6. A printer comprising:

a housing for storing continuous paper;

a cover pivotally disposed to the housing such that the cover can be moved in a cover closing direction to a closed position or in a cover opening direction to an open position;

a lock mechanism including a first engaging unit disposed to the housing and a second engaging unit disposed to the cover for locking the cover when in the closed position;

a release member for moving the second engaging unit to release its engagement; and a cutting mechanism including a movable knife disposed on the housing side, a stationary knife disposed on the cover side, and an urging member for urging the stationary knife in the cover closing direction;

wherein the stationary knife contacts the housing and is positioned to the movable knife by being urged by the urging member to the housing side when the cover is in the closed position;

a contact part disposed to the stationary knife for contacting the housing side when the cover is closed; and wherein said urging member is connected and positioned for urging the stationary knife in the closing direction of the cover such that when the cover is in the closed position the cover is pressed in the cover opening direction which causes the cover to move forward in the cover opening direction when unlocking the locking mechanism and releasing the engagement of the first and second engaging unit.

7. The printer of claim 1, wherein the positioning and urging mechanism is for directing the cover to move in the opening/closing direction relative to the open or closed position of the cover so as to minimize play when the cover is locked in the closed position.

8. The printer of claim 1, wherein the cover-side contact part is disposed to the cover in an arrangement relative to the body of the printer such that when the cover is in the closed position the cover-side contact part is pressed into the body of the printer to cause the cover to move into the open position in response to the unlocking of the cover by the lever.

* * * * *